US005448262A

United States Patent [19]

Lee et al.

[11] Patent Number: 5,448,262

[45] Date of Patent: Sep. 5, 1995

[54] DISPLAY SCREEN BLANKING USING INTERACTIVE VIDEO AND USER-INTERFACE MONITORING

[75] Inventors: HongTsan Lee, Cupertino; Jung-Chih Huang, Santa Clara; Terng-Huei Lai, Milpitas, all of Calif.

[73] Assignee: ACC Microelectronics Corporation, Santa Clara, Calif.

[21] Appl. No.: 158,647

[22] Filed: Nov. 29, 1993

[51] Int. Cl.[6] ..... G09G 5/00

[52] U.S. Cl. ..... 345/212; 348/173

[58] Field of Search ..... 307/592, 593; 395/152; 345/211, 212, 213, 168; 364/707; 348/173

[56] References Cited

U.S. PATENT DOCUMENTS

| | | | |
|---|---|---|---|
| 3,928,960 | 12/1975 | Reese | 364/707 |
| 4,158,230 | 6/1979 | Washizuka et al. | 364/707 |
| 4,677,430 | 6/1987 | Falkman et al. | 348/173 |
| 5,059,961 | 10/1991 | Cheng | 345/10 |

FOREIGN PATENT DOCUMENTS

| | | | |
|---|---|---|---|
| 3-20783 | 1/1991 | Japan | 345/211 |

*Primary Examiner*—Richard Hjerpe
*Attorney, Agent, or Firm*—Schneck & McHugh

[57] ABSTRACT

A method and apparatus for reducing power consumption by a display device includes monitoring time intervals between successive updates by video update circuitry and time intervals between successive uses by one or more user-interface devices, such as a mouse or keyboard. A first time-elapsed signal is generated if a predetermined time interval is exceeded between successive uses by the user-interface devices. A reset input to a first timer is connected to the user-interface devices to restart the timing with each use. A second time-elapsed signal is generated if the interval between successive video updates exceeds a second predetermined time period. Video updating resets the timer used to monitor the video update circuitry, but once the second time-elapsed signal has been initiated, a video update will not disable the signal. Rather, the second time-elapsed signal is latched until the use of a user-interface device. Simultaneous occurrence of the first and second time-elapsed signals generates an interrupt signal for reducing power consumption by a display device.

17 Claims, 2 Drawing Sheets

DISPLAY SCREEN BLANKING USING INTERACTIVE VIDEO AND USER-INTERFACE MONITORING

TECHNICAL FIELD

The present invention relates generally to controlling power consumption by a display device and more particularly to timing circuits and methods of selectively interrupting power to a display device.

BACKGROUND ART

Driving a display device, such as a computer monitor or a liquid crystal display (LCD), accounts for a substantial percentage of the power consumed in operating a computer system. Thus, a major source of energy inefficiency in computer operation is the requirement to drive a display device during periods of inactivity. The energy inefficiency is particularly disadvantageous in circumstances in which power is supplied by a battery, e.g. a laptop computer.

Circuits for blanking a display screen during periods of inactivity are known. Screen blanking conserves power and extends the charge life of a battery. Moreover, screen blanking prevents image "burn-in," i.e. screen phosphor deterioration that leaves a permanent ghost image if the same image is left on a screen for an extended period of time.

A simple screen saving circuit is one in which a single timer is connected to monitor activity by user-interface devices and by video random access memory (VRAM). In the absence of any activity, the timer issues an interrupt that disables power to a display device. "User-interface devices" is defined herein as devices used by an operator of a computer system to input data or commands. User-interface devices include a keyboard, a mouse and a touch-screen display device. Activity by the user-interface device or activity at the output of the VRAM will reset the timer and, if the interrupt has been issued, will disable the interrupt to return power to the display device.

A modification of the circuit is to provide separate timers for monitoring VRAM activity and activity by the user-interface device. The timers can be set to measure different periods of time, with each timer being connected to initiate generation of an interrupt. A double-timer circuit requires additional hardware logic and a more complicated software implementation, but resolution is enhanced.

A third screen blanking circuit is described in U.S. Pat. No. 5,059,961 to Cheng. The screen blanking circuit of Cheng has three inputs. A first input is connected to the VRAM of a computer system. The second and third inputs receive the horizontal and vertical synchronizing signals from a cathode ray tube (CRT) controller of a display device to be selectively disabled. If during a selected time period no read/write signal is received from the VRAM along the first input, the horizontal and vertical synchronizing signals are electrically disconnected from the display device, causing the data image to disappear.

One problem with the Cheng circuit is that electrically disconnecting the horizontal and vertical synchronizing signals to the display device does not turn the display device "off." While power consumption is reduced, the cathode ray tube itself remains "on." The tube beam will not sweep, but instead will be substantially fixed. Another problem is that the Cheng circuit is limited to use with cathode ray tubes. Portable computer systems typically use LCD devices and other means which do not require horizontal and vertical synchronizing signals.

One difficulty of each of the screen blanket circuits described above is that monitoring video circuitry, such as the VRAM, will potentially defeat the purpose of the circuit. For example, if the display includes a digital clock, a video update will occur every second. If the VRAM timer is set to measure a period greater than one second, the screen will remain on continuously. On the other hand, if the time is set for less than one second, the screen will turn off, but will turn back on at the one-second update. The frequent on/off fluctuation will not result in a savings of power and will likely shorten the use-life of the display device. At the very least, the frequent switching will be a source of distraction to the user. Similar problems are encountered during protracted "number crunching" performed by a spreadsheet program. During the time necessary to reach a file tally, the video may be updated periodically with intermediate results. Each update will cause a screen blanker to turn the screen back on, even though the user is likely to have no interest in the intermediate results.

An object of the present invention is to provide an apparatus and method for controlling video display in an efficient manner without encountering problems caused by managing video updating circuitry.

SUMMARY OF THE INVENTION

The above object has been met by an apparatus and method in which interactivity between monitoring video updates and monitoring user-interface devices functions to limit the ability of video updating to restore a display after screen blanking has been established. Separate timers are used for timing periods of inactivity for video updating and one or more user-interface devices, but after an interrupt signal has been generated by the combination of the two timers, only activity by a user-interface device will terminate the interrupt signal and restore video.

A first of the two timers is a user timer, having a reset input connected to detect activity by one or more user-interface device. Typical user-interface devices include keyboards, mice and touch-screen displays, but other devices may also be monitored. The user timer is set to count a predetermined time interval. Any activity by a user-interface device will reset the timer. However, if the time between two resets exceeds the predetermined time interval of the timer, the user timer will initiate a first time-elapsed signal.

The second timer is connected to monitor activity by video updating circuitry. For example, the timer may be connected to VRAM of a computer system. The video timer is set to measure a time interval that is typically, but not critically, shorter than the predetermined time interval of the user timer. A video update will reset the video timer. If the time between successive resets exceeds the time interval set for the video timer, a set signal is generated. The set signal is received by a latch which will then output a second time-elapsed signal. Simultaneous generation of the time-elapsed signals from the user timer and the latch will initiate the interrupt signal. The interrupt signal may be directed to hardware control devices that provide screen blanking of a CRT, an LCD or the like, or may be used with software techniques for screen blanking, e.g. the interrupt may be a system management interrupt (SMI) to the control processor unit of a computer system.

An important feature of the circuit is that once the latch has been set by the set signal from the video timer, the second time-elapsed signal is output from the latch until the next occurrence of activity by a user-interface device. That is, the latch is reset by user activity and not video activity. The user activity will also reset the video timer. In one embodiment, the user-interface device is connected to resets of the user timer, the video timer and the latch. However, other embodiments are contemplated. For example, the reset of the video timer and the latch may be connected to the output of the user timer by an inverter, so that terminating a time-elapsed signal from the user timer will reset the video timer and the latch.

An advantage of the present invention is that by requiring user-interface monitoring to interact with video monitoring in order to disable the interrupt signal, updating video that is not of consequence to a user will not remove a display system from a power-saving mode. For example, if a display includes a digital clock, a one second update will not disable the interrupt signal in the absence of activity at a user-interface device such as a mouse. Likewise, updating a complex spreadsheet with intermediate results during computer "number crunching" to reach a final tally will not disable the interrupt signal. In another example, where the screen blanking is used in combination with a screen saver, periodic changes of video by the screen saving program will not disable the screen blanking in the absence of activity by a user.

BEST MODE FOR CARRYING OUT THE INVENTION

Figure 1:
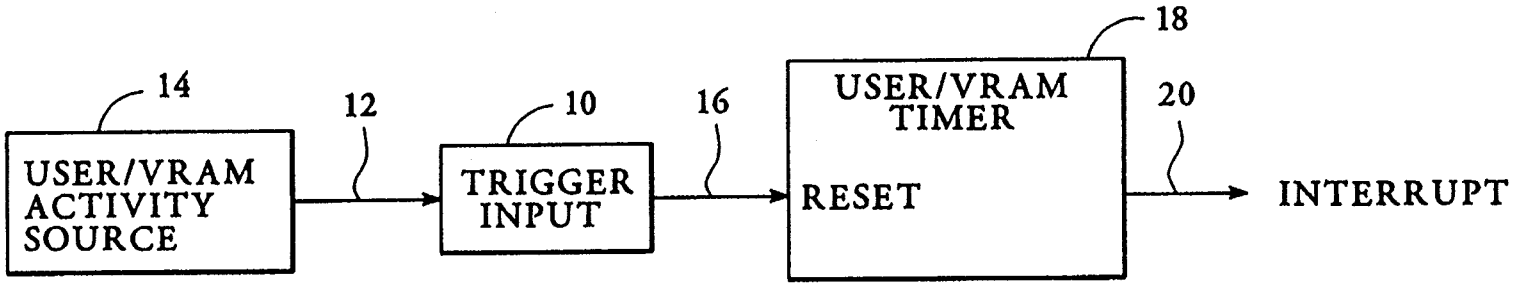
FIG. 1 (PRIOR ART)
FIG. 1 is a schematic view of a first prior art screen blanking circuit.

With reference to FIG. 1, a prior art screen blanking circuit is shown as including a trigger input 10 connected to a signal line 12 of a source 14 or sources of a signal indicative of activity by one or more user-interface devices and video activity. The trigger input 10 acts as a detector to output a reset signal along line 16 to a user/VRAM timer 18.

Activity by a user-interface device or an output from the VRAM will result in a reset signal being transmitted along line 16 to a reset input of the timer 18. The reset signal may be a logic "high," but this is not critical. In the absence of activity, the reset signal line 16 will remain at a logic "low," allowing the timer 18 to run continuously. After a preselected time interval, an interrupt signal will be generated along line 20. The interrupt signal is connected to circuitry for blanking the screen of a display device, not shown.

In circumstances identified above, the screen blanking circuit of FIG. 1 will create difficulties. For example, if a display includes a digital clock, the VRAM will update the video every one second. Thus, the timer 18 will be reset each second. If the preselected time is greater than one second, the circuit will not generate an interrupt signal along line 20 regardless of activity or inactivity by a user. On the other hand, if the timer is set for a period less than one second, the interrupt signal will be generated, but the one second update will disable the interrupt signal, causing the display device to fluctuate from an on state to an off state every one second. The frequency of fluctuation will defeat the purpose of the circuit and will be distracting to a user.

Figure 2:
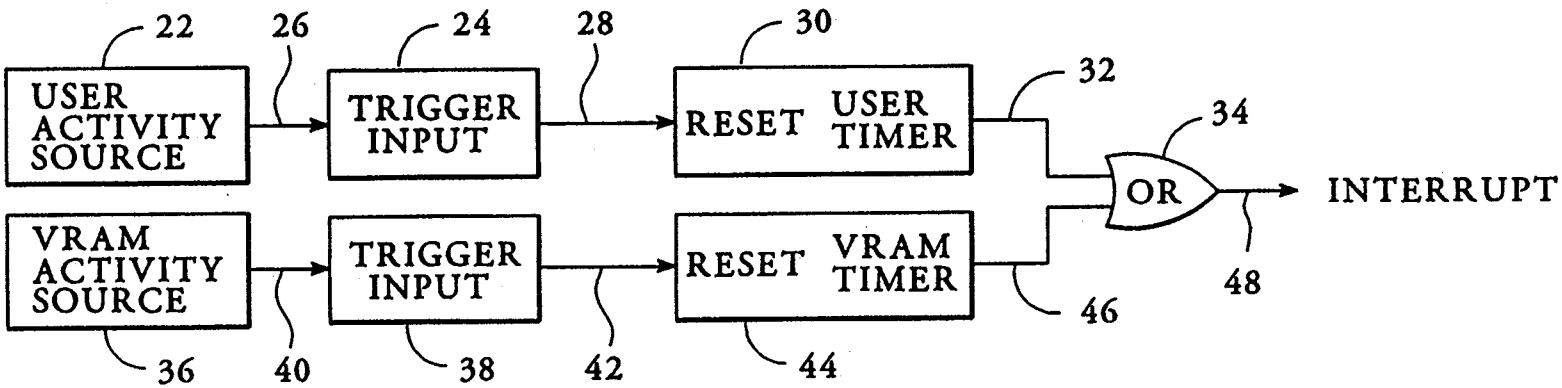
FIG. 2 (PRIOR ART)
FIG. 2 is a schematic view of a second prior art screen blanking circuit.

A second prior art screen blanking circuit is shown in FIG. 2. In this circuit, user activity and video activity are monitored in parallel. With regard to user activity, a source 22 of a signal indicative of activity is connected to a trigger input 24 by a signal line 26. Activity at a user-interface device will result in transmission of a reset signal along a line 28 from the trigger input to a user timer 30. The user timer is programmed to measure a selected time interval between successive reset signals. If the time interval is exceeded, an appropriate signal is transmitted along an input line 32 to an OR gate 34.

A source 36 of VRAM activity is connected to a second input trigger 38 by a signal line 40. During periods of video activity, a reset signal is transmitted along a line 42 to a VRAM timer 44. The reset signal resets the timing sequence of the VRAM timer. In the absence of a reset signal, the timer will count a preselected time interval, after which an appropriate signal will be sent along a second input line 46 to the OR gate 34. An interrupt signal is transmitted along an output line 48 of the OR gate when either the user timer 30 or the VRAM timer 44 has determined that the appropriate time interval has lapsed.

An advantage of the prior circuit of FIG. 2 over the prior art circuit of FIG. 1 is that efficiency is improved by allowing a user to select a user inactivity time interval that is different from the VRAM inactivity time interval. Typically, the VRAM timer is set to measure a time less than that of the user timer. However, the circuit of FIG. 2 shares the problem of the circuit of FIG. 1, i.e., video updating that is not of consequence to an operator will terminate the screen blanking.

Figure 3:
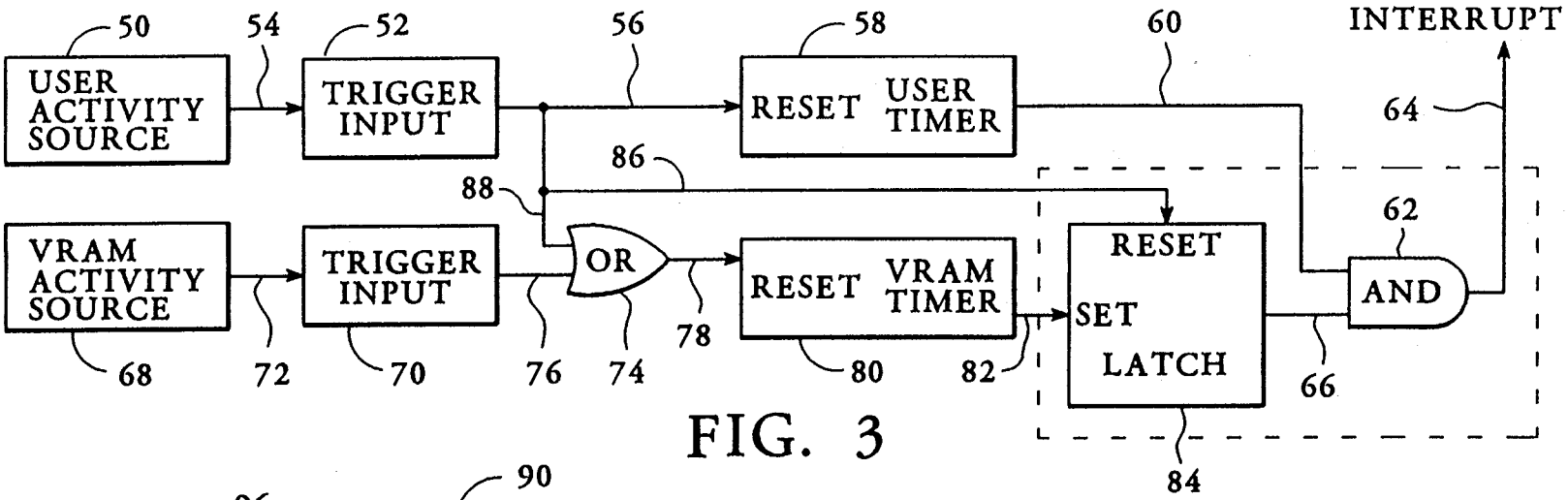
FIG. 3 is a schematic view of an interactive screen blanking circuit in accordance with the present invention.

The efficiency of screen blanking is enhanced by the interactive circuit of FIG. 3. A source 50 indicative of activity by one or more user-interface devices is connected to a first trigger input 52 by a signal line 54. Activity at a user-interface device will cause the trigger input 52 to generate a first reset signal along line 56 to a user timer 58. The user timer is set to measure some preset time interval, e.g., five minutes. Preferably, the operator is able to select among different times for the user timer 58. While not critical, the first reset signal may be a logic high. A high along line 56 then restarts the user timer 58. However, if the time interval between successive resets exceeds the selected time interval of the user timer 58, a first time-elapsed signal is generated along an input line 60 to an AND gate 62. To this point, the circuit works in the same manner as the prior art circuit of FIG. 2, with the exception that the signal from the user timer 58 is input to an AND gate, rather than an OR gate. Thus, the first time-elapsed signal from the user timer 58 will not initiate an interrupt signal along an output line 64 from the AND gate. If the time-elapsed signal is a logic high, the interrupt signal is generated only when combined with a high at a second input line 66 of the AND gate 62. The latch and the AND gate comprise an interrupt circuit shown in dashed lines in FIG. 3.

A source 68 indicative of activity by video updating circuitry, such as a VRAM, is connected to a second input trigger 70 by a signal line 72. Video updating will result in a second reset signal being transmitted to an OR gate 74 via line 76. A high at the OR gate is channeled along line 78 to a reset input of a VRAM timer 80. The VRAM timer counts during time intervals between successive resets. If a preselected time interval is exceeded, a set signal is transmitted along a signal line 82 to a latch 84. Once set by a set signal from line 82, the latch 84 will maintain a second time-elapsed signal along the input line 66 of the AND gate 62, regardless of changes in the logic state at the set signal line 82. Only a reset signal along a signal line 86 will disable the second time-elapsed signal to the AND gate once the latch has been set.

Resetting the latch 84 is accomplished by transmission of the same signal that resets the user timer 58. The signal line 86 is connected to the first reset signal line 56. Also connected to the first reset line is an input line 88 to the OR gate 74. Consequently, user activity at a user-interface device connected to the source 50 will reset each of the user timer 58, the VRAM timer 80 and the latch 84.

In operation, the user timer 58 and the VRAM timer 80 are programmed for set periods of time. An activity by the VRAM or analogous video updating circuitry will trigger a reset of the VRAM timer 80 via the OR gate 74. At the reset, the count begins and if a second reset does not occur before the selected time interval, a set signal is generated along line 82. The set signal initiates a second time-elapsed signal along input line 66 to the AND gate 62. If a first time-elapsed signal is simultaneously received along input line 60, the AND gate will output an interrupt signal along line 64. The first time-elapsed signal is present after the selected period of time of the user timer has expired between a first-occurring reset and a second-occurring reset of the user timer.

After the latch 84 has been set, subsequent video updates will not effect the output of the interrupt signal along line 64. However, activity by a user-interface device will disable the interrupt signal. Such use causes a reset signal along lines 56, 86 and 88 from the trigger input 52. Consequently, each of the timers 58 and 80 and the latch 84 are restarted and signals outputted thereby are disabled.

As can be seen, the updating of the digital clock every second will not terminate screen blanking. By setting the VRAM timer to an interval of less than one second, the display screen will be blanked during extended periods of inactivity by user-interface devices.

The interrupt signal at output line 64 may be used in conjunction with hardware to terminate power to a display device, such as a computer monitor or LCD device. Alternatively, the interrupt signal may be a system management interrupt (SMI) to a CPU to accomplish screen blanking by software techniques.

While the circuit of FIG. 3 includes trigger inputs 52 and 70 that function in the same manner as a detector to sense activity, the trigger inputs are not critical. Other techniques for resetting the timers 58 and 80 at the relevant activities will be understood by persons skilled in the art. For embodiments which utilize trigger inputs, a separate such input may be used for each user-interface device of a computer system.

Figure 4:
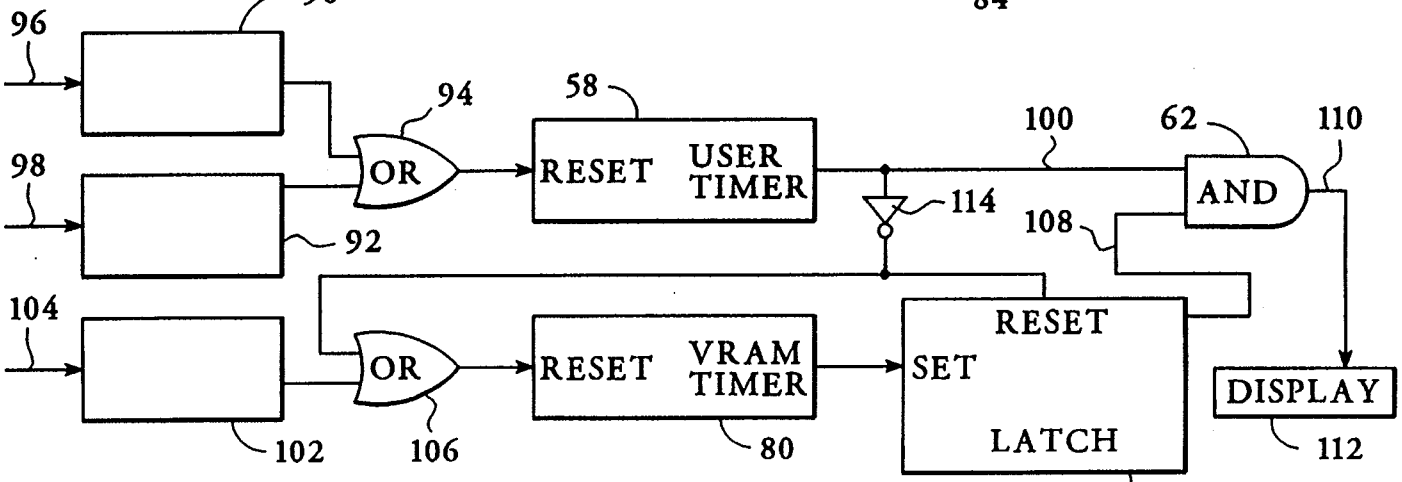
FIG. 4 is a schematic view of a second embodiment of an interactive screen blanking circuit in accordance with the present invention.

A second embodiment of an interactive circuit for screen blanking is shown in FIG. 4. A user timer 58, a VRAM timer 80, a latch 84 and an AND gate 62 are identical to the components of FIG. 3, and are therefore provided with the same reference numerals. User-interface devices 90 and 92 are connected to a first OR gate 94. One such device 90 may be a keyboard, while the other device 92 may be a mouse. The components 90 and 92 alternatively may be trigger inputs connected to user-interface devices via signal lines 96 and 98. When either input to the OR gate 94 goes to a logic high, the user timer 58 will be reset. If the interval between successive resets exceeds the programmed time, the user timer will generate a first time-elapsed signal along input line 100 to the AND gate 62.

Video update circuitry 102 or a trigger input connected to such circuitry via line 104 provides an input to a second OR gate 106. A video update will reset the VRAM timer 80. The absence of the timely reset will result in the latch 84 being set, thereby initiating a second time-elapsed signal to the AND gate 62 by means of input line 108.

Simultaneous receipt of first and second time-elapsed signals along input lines 100 and 108 will result in generation of an interrupt signal at output line 110. The interrupt signal is received at a display 112. In a preferred embodiment, the screen of the display 112 will be blanked. However, other means for conserving power during periods of inactivity may be initiated by receipt of the interrupt signal.

In comparison to the circuit of FIG. 3 in which each of the reset lines 56, 86 and 88 are tied together, in FIG. 4 the output of the user timer 58 is inverted at inverter 114 and used to reset the latch 84 directly and to reset the VRAM timer 80 via the second OR gate 106. However, operation of the interactive circuits of FIGS. 3 and 4 are basically identical.

We claim:

1. An apparatus for controlling video display comprising:

a first signal line connected to indicate activity by a user-interface device;

a second signal line connected to indicate activity by video update circuitry;

first timer means, having a reset input connected to said first signal line, for generating a first time-out signal upon determining lapse of a predetermined period of time between successive indications of activity by said user-interface device;

second timer means, having a reset input operationally associated with both said first and second signal lines, for generating a second time-out signal upon determining lapse of a selected period of time between successive indications of activity by said video update circuitry, wherein a signal present on said first signal line terminates said first and second time-out signals; and interrupt circuitry having a first input in electrical communication with said first timer means and having a second input in electrical communication with said second timer means, said interrupt circuitry having means for generating an interrupt signal upon receiving both of said first and second time-out signals, said interrupt circuitry further having means for sustaining said interrupt signal in the absence of an indication of user-interface activity along said first signal line;

wherein an indication of activity by said video update circuitry is ineffective with respect to terminating said interrupt signal.

2. The apparatus of claim 1 wherein said second time-out signal is terminated only by a signal present on said first signal line and means for generating said interrupt signal includes an AND gate and wherein said means for sustaining said interrupt signal is a latch.

3. The apparatus of claim 1 wherein said first timer means is set to measure a predetermined period of time that exceeds the selected period of time of said second timer means.

4. The apparatus of claim 1 wherein each of said first and second signal lines has a first logic state indicative of activity and a second logic state indicative of inactivity, each of said first and second timer means connected to reset with respect to measuring time whenever said reset input of said each first and second timer means is at said first logic state.

5. The apparatus of claim 1 wherein said means for sustaining said interrupt signal is a latch connected between said second timer means and said means for generating said interrupt signal, said latch having a reset connected to said first input line for terminating said interrupt signal upon indication of activity by said user-interface device.

6. The apparatus of claim 5 wherein said reset input of said second timer means is in electrical communication with each of said first and second signal lines.

7. The apparatus of claim 1 further comprising switching means connected to receive said interrupt signal for terminating power to a display device in response to said interrupt signal.

8. An apparatus for controlling video display comprising:

user-activity means connected to a user device for generating an output having a first logic state indicative of activity by said user device and having a second logic state indicative of inactivity by said user device;

video-activity means connected to video circuitry for generating an output having a first logic state indicative of selected activity by said video circuitry and having a second logic state indicative of inactivity;

a first timer having a reset connected to said user-activity means to reset said first timer in response to said first logic state being output by said user-activity means, said first timer having means for generating a first time-elapsed signal upon passage of a selected time interval between successive resets;

a second timer having a reset connected to said video-activity means to reset said second timer in response to said first logic state being output by said video-activity means, said second timer having means for generating a set signal upon passage of a selected time interval between successive resets;

latch means having a set input connected to said second timer for generating a second time-elapsed signal in response to receiving said set signal from said second timer, said latch means having a reset in electrical communication with said user-activity means to terminate said second time-elapsed signal in response to said first logic state being output by said user-activity means; and means connected to said first timer and said latch for reducing power consumption by a display device during time periods of simultaneous receipt of each of said first and second time-elapsed signals.

9. The apparatus of claim 8 wherein said means for reducing power consumption includes an AND gate having a first input connected to said first timer and having a second input connected to said latch means.

10. The apparatus of claim 8 further comprising an OR gate having inputs connected to receive said outputs of each said user-activity means and said video-activity means and having an output connected to said reset of said second timer.

11. The apparatus of claim 8 wherein said output of said user-activity means is in electrical communication with each of said resets of said first and second timers and said latch means.

12. A method of reducing power consumption by a display device comprising:

monitoring time intervals between successive uses of at least one user-interface device of a computing system;

initiating a first time-elapsed signal when a time interval between successive uses exceeds a first predetermined time period;

terminating said first time-elapsed signal only upon a subsequent use of a user-interface device;

monitoring time intervals between successive updates by video update circuitry;

initiating a second time-elapsed signal when a time interval between successive updates by said video update circuitry exceeds a second predetermined time period;

terminating said second time-elapse signal only upon a subsequent use of a user-interface device; and generating an interrupt signal for reducing power consumption by a display device during time periods in which each of said first and second time-elapsed signals is being generated.

13. The method of claim 12 wherein monitoring said time intervals between successive uses is a step including timing said time intervals and restarting the timing upon each use of said at least one user-interface device.

14. The method of claim 12 wherein monitoring said time intervals between successive updates is a step including timing said time intervals and restarting the timing upon each update by said video update circuitry.

15. The method of claim 12 wherein monitoring said time intervals between successive updates is a step of monitoring output from video RAM.

16. The method of claim 12 wherein initiating said second time-elapse signal includes generating a set signal and latching said set signal until a subsequent use of a user-interface device.

17. The method of claim 12 wherein terminating said first and second time-elapsed signals includes restarting timing said time intervals between successive uses and between successive updates.

* * * * *